US005134947A

United States Patent [19]

Price et al.

[11] Patent Number: 5,134,947

[45] Date of Patent: Aug. 4, 1992

[54] METHOD AND APPARATUS FOR FORMING AND EVERTING A WORK PRODUCT

[75] Inventors: Elvin C. Price, Dacula; Preston B. Dasher; Erie G. Huddleston, both of Lawrenceville, all of Ga.

[73] Assignee: Atlanta Attachment Company, Lawrenceville, Ga.

[21] Appl. No.: 678,641

[22] Filed: Apr. 1, 1991

Related U.S. Application Data

[63] Continuation-in-part of Ser. No. 630,841, Dec. 20, 1990.

[51] Int. Cl.[5] ..... D05B 27/00; D05B 33/00

[52] U.S. Cl. ..... 112/63; 112/121.29; 112/262.2; 112/288; 112/304; 112/DIG. 2

[58] Field of Search ..... 112/63, 121.15, 121.29, 112/262.2, DIG. 2, DIG. 1, 288; 223/38, 42, 43

[56] References Cited

U.S. PATENT DOCUMENTS

| | | | |
|---|---|---|---|
| 3,568,898 | 3/1971 | Griffin, Jr. | 223/43 |
| 3,577,942 | 5/1971 | Hulin | 223/43 X |
| 3,977,580 | 8/1976 | Vecchia | 223/43 |
| 4,519,327 | 5/1985 | Selvi | 112/121.15 |
| 5,031,551 | 7/1991 | Graham | 112/262.2 X |

OTHER PUBLICATIONS

*Keeps on picking* by PickRobotics (one page).

*Finishing* by Sunbrand, pp. 997, 998, 999 and 1000.

*Primary Examiner*—Werner H. Schroeder

*Assistant Examiner*—Paul C. Lewis

*Attorney, Agent, or Firm*—Hopkins & Thomas

[57] ABSTRACT

An overlock stitch is formed by sewing machine (11) (FIG. 1) into a work product (34) and the work product is accelerated away from the sewing machine so as to stretch the thread chain (FIG. 5). The stretched thread chain is cut by cutter (40), and the leading thread chain (43) recoils back toward the hollow chaining tongue (21) and is drawn into the chaining tongue by the stream of air (26) created by vacuum canister (52) (FIG. 6). The next work product draws the leading thread chain out of the hollow chaining tongue and the sewing machine captures the leading thread chain in the stitch. Transfer conveyor (15) (FIG. 1) moves the work product (34) into alignment with everter tube assembly (106), grippers (109) and (110) grip and open one end of the work product (FIGS. 9–14), and air drawn through the everter tube assembly everts the work product. The gripper tube assembly opens along its lower portion (FIG. 16) and drops the work product.

14 Claims, 8 Drawing Sheets

TIMING DIAGRAM

METHOD AND APPARATUS FOR FORMING AND EVERTING A WORK PRODUCT

CROSS REFERENCE

This is a continuation in part of U.S. patent application 630,841, filed Dec. 20, 1990.

TECHNICAL FIELD

This invention relates to an attachment for a sewing machine, particularly to an attachment which everts a generally cylindrical work product formed by a sewing machine, and stacks the work product.

BACKGROUND OF THE INVENTION

When forming sleeves and other generally cylindrical garment parts of textile material, a conventional procedure is to fold a ply of garment material with the finished surfaces facing each other and to sew with an overlock stitch along the aligned edges of the material. This forms the work product inside out. Once formed in this manner, the work product must be everted or turned right side out, usually by a worker reaching through the cylindrical garment part, grasping the distal end, and pulling the distal end back through the cylindrical portion of the garment part.

While the typical experienced worker can evert sleeves, pant legs, etc., relatively expediently during the garment production process when arranging the garment parts for the next sewing step, etc., the physical hand movements of the worker for everting the garment parts over a full day's work require a substantial amount of time and become tedious to the worker. Moreover, as the sleeve lengths become longer, the job of everting the sleeves becomes more onerous.

SUMMARY OF THE INVENTION

Briefly described, the present invention comprises a method and apparatus for forming and everting a work product, particularly cylindrical garment parts, such as sleeves and pant legs. Garment material is folded over on itself and its edges aligned, and the garment material is moved through a finishing apparatus such as a sewing machine which forms stitching in the aligned edges of the garment material. Preferably the garment is sewn with an overlock stitch, having a latch back of the thread chain in the leading end of the garment part and a short tail of thread chain extending from the trailing end of the garment part. Once sewn, the garment part is engaged by a transfer plate and slid across the work table in a path away from the sewing station where it is out of the way of the next oncoming garment part, and is aligned with an everter.

Once the garment part has been aligned with the everter a pair of grippers engage and open the end of the garment part adjacent the everter. Air is induced to flow through the open end of the garment part and into the everter, thereby drawing the distal end of the garment part through the opened end of the garment part, which everts the garment part.

The everter includes a cylindrical air induction everter tube which communicates at one of its ends with the inlet of a blower. The air induction everter tube is formed in longitudinally extending side-by-side sections that form upper and lower longitudinally extending seams, and after the everter tube has received an everted garment part its sections move away from each other in timed relationship with the intermittent flow of air and the operation of the grippers, so as to drop the everted garment part to a stack of the garment parts.

Thus, it is an object of this invention to provide a method and apparatus for forming and everting a work product, particularly cylindrical garment parts, whereby each garment part is expediently and automatically removed in sequence from the sewing area of a sewing machine away from the next oncoming garment part and aligned with an everter, and automatically everted and stacked by the everter.

Another object of this invention is to provide an improved everter for use in combination with a sewing machine which expediently and reliably everts the garment parts sewn by the sewing machine without requiring monitoring by the sewing machine operator.

Another object of this invention is to provide an improved garment part everter which functions automatically to open one end of a tubular shaped garment part and to draw a stream of air backwardly through the opened end of the tubular garment part so as to turn the garment part right side out.

Another object of this invention is to provide an automatic garment part everter which is adapted to turn inside out cylindrical garment parts right side out, and which operates in timed relationship with a sewing machine to reliably, accurately and expediently remove a garment part from the sewing machine and to turn and stack the garment part.

Other objects, features and advantages of this invention will become apparent upon reading the following specifications, when taken in conjunction with the accompanying drawings.

DETAILED DESCRIPTION

Figure 1:
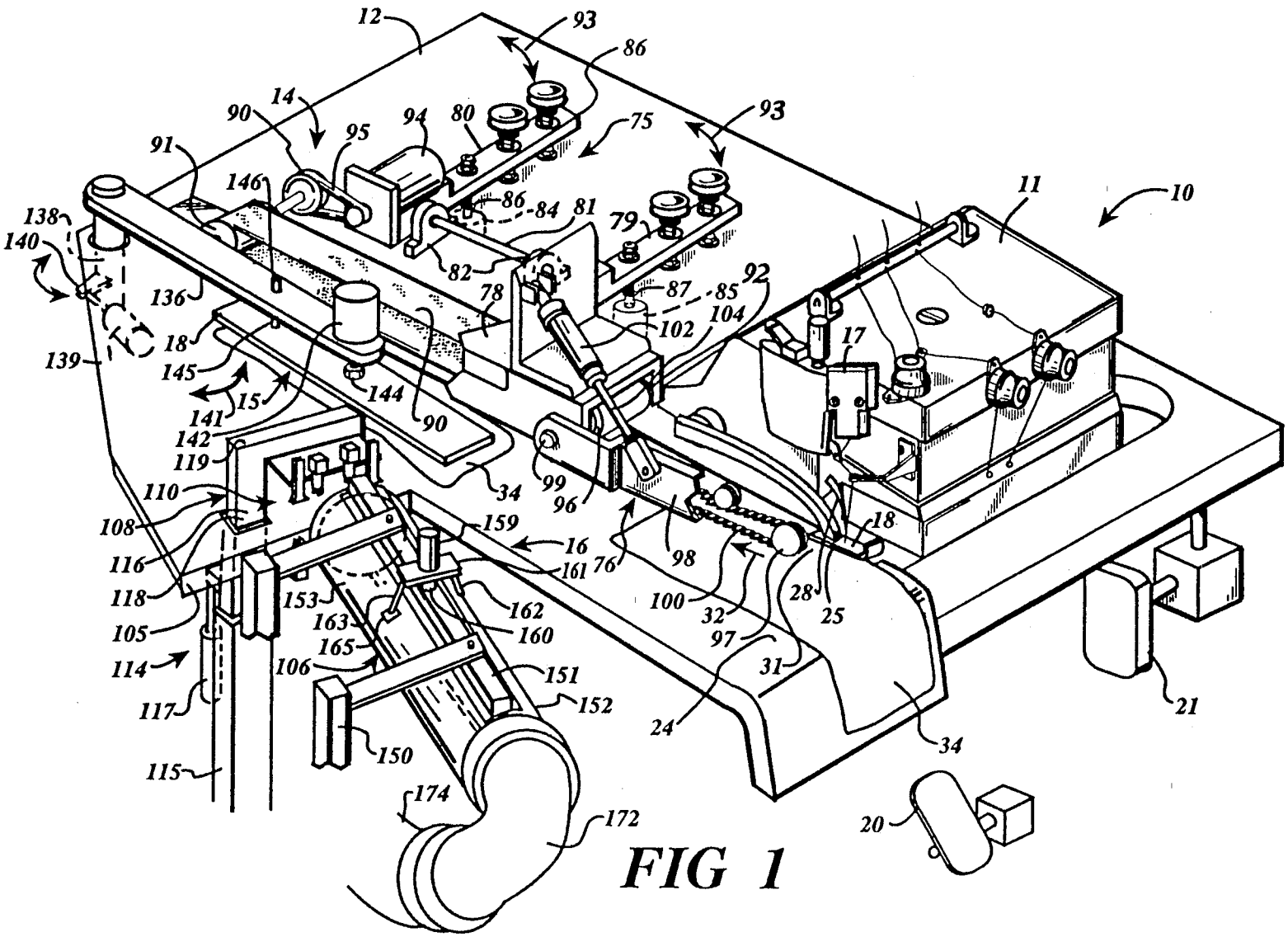
FIG. 1 is a perspective illustration of the method and apparatus for forming and everting a work product.

Referring now in more detail to the drawings, in which like numerals indicate like parts throughout the several views, FIG. 1 illustrates the garment forming and everting system 10 which includes a sewing machine 11 mounted to a work table 12, a conveyor system 14, a transfer conveyor 15 and an everter system 16. A photoelectric detector 17 is mounted at the sewing machine to detect the movement of the work products 34 through the sewing area 31 of the sewing machine and to actuate the computer control system for the system 10.

Figure 14:
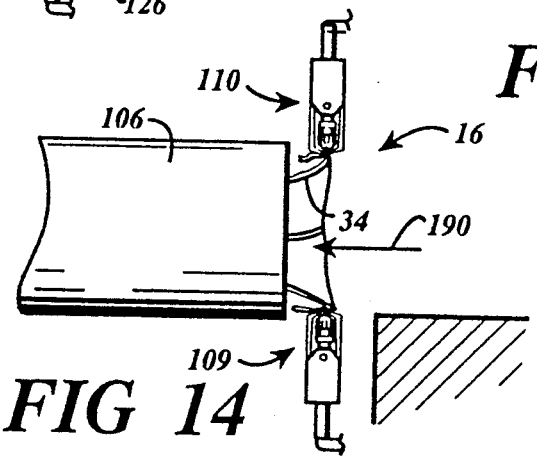

Sewing machine 11 functions to form overlock stitches 38 (FIG. 5) in the overlying edges of the work product 34 that has been precut into the proper shape and folded to form a garment sleeve, pant leg or other substantially cylindrical shaped garment part, etc. As the stitches are being formed at the edges of the work product by the sewing machine 11 (FIGS. 3 and 4), conveyor system 14 moves the work product 34 further along the sewing path 32, away from the sewing machine and out of the way of the next oncoming work product. Transfer conveyor 15 (FIG. 1) engages the work product 34 by moving its clamp bar 18 down into engagement with the work product as the conveyor system 14 releases the work product, and the transfer conveyor moves into alignment with the everter system 16. The everter system opens an end of the work product (FIGS. 9–13), and air is induced to flow through the everter system 16 and backwards through the work product 34 to evert the work product (FIG. 14). Once everted, the work product is dropped by the everter system 16 (FIGS. 15 and 16) into a stack (not shown) of the work products.

Figure 2:
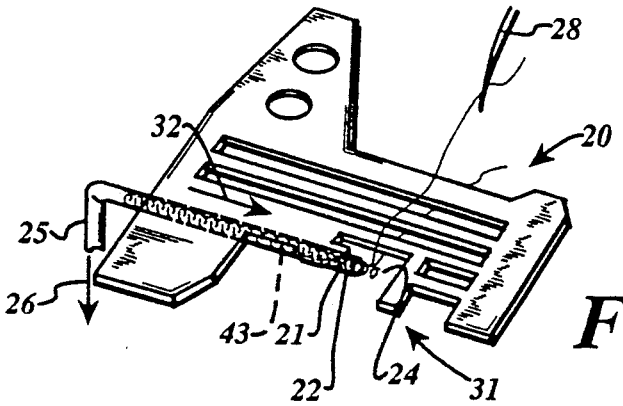
FIG. 2 is a perspective illustration of a throat plate for the sewing machine, showing the overlock chain stitch drawn by a stream of air into the hollow chaining tongue.
Figure 3:
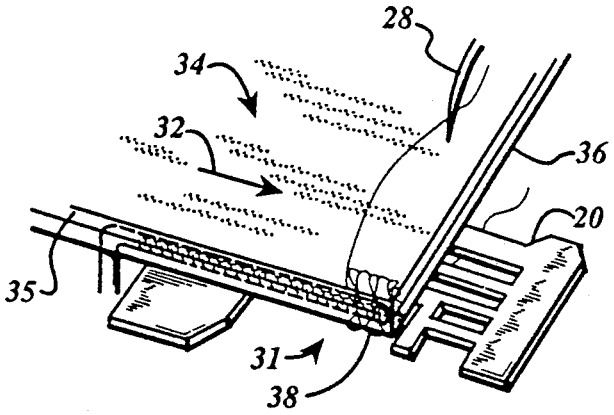
FIG. 3 is a perspective illustration of the throat plate, similar to FIG. 2, but showing the work product as it moves across the throat plate and receives the overlock stitch and begins to pull the leading thread chain from the chaining tongue.
Figure 4:
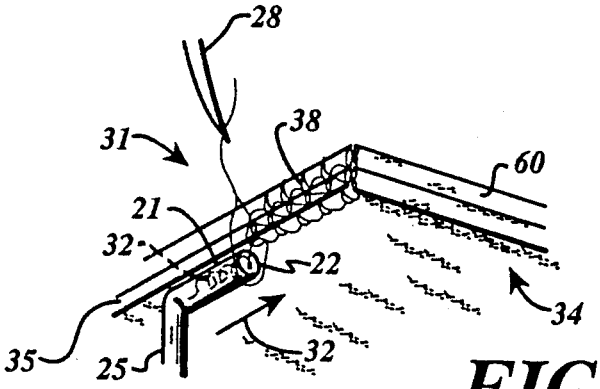
FIG. 4 is a perspective illustration of a small portion of the work product, showing schematically how the overlock stitch surrounds both the edge of the work product and the chaining tongue.

As shown in more detail in FIGS. 2–4, the sewing machine 11 includes a throat plate 20 that is positioned over feed dogs (not shown) and beneath the presser foot (not shown) in the conventional manner. Throat plate 20 includes a chaining tongue 21 that has an open end 22 extending into an open space 24 of the throat plate, and the other end of the chaining tongue communicates with air conduit 25 which, in turn, communicates with a vacuum canister 52 (FIG. 6) which comprises a source of negative air pressure so as to induce a stream of air to flow into the open end 22 of the chaining tongue 21, as indicated by arrow 26.

Sewing needles, such as the upper sewing needle 28 of sewing machine 11, function to form an overlock stitch about the chaining tongue 21 in the conventional manner. For example, the sewing machine can comprise a Wilcox and Gibbs or Union Special sewing machine of the type that forms an overlock stitch, otherwise designated as stitch type 504 of the Federal Standard, Stitches, Seams, and Stitchings, Fed. Std. No. 751a. The overlock stitch is formed with three threads, one needle thread, one looper thread and one cover thread. When the sewing machine runs off the work product 34, a thread chain 29 is formed (FIG. 5) by the needles which extends rearwardly from the previously formed work product, and the thread chain will be joined to the oncoming work product. Thus, the successive work products will be joined by thread chains, unless the thread chains are cut as described in more detail hereinafter. If the thread chain 29 is cut, it forms a trailing thread chain 44 which is attached to the preceding work product 34 and a leading thread chain 43 which will become attached to the next work product.

FIG. 2 illustrates the leading thread chain 43 which is drawn into the chaining tongue 21 by the stream of air indicated at 26. The thread chain 43 is cut from the preceding work product that passed through the sewing area 31 of the sewing machine, having moved along the sewing path as indicated by arrow 32.

As illustrated in FIG. 3, when the work product 34 moves through the sewing area 31 the sewing needles 28 begin the formation of an overlock stitch 38 along the side edge 35 of the work product. As the leading edge 36 of the work product passes over the chaining tongue 21 and the overlock stitches 38 begin to be formed, the anchoring of the threads to the work product 34 causes the leading thread chain 43 to be progressively pulled out of the chaining tongue 21 in response to the movement of the work product 34 along the sewing path 32.

As shown in FIG. 4, the overlock stitches 38 are formed by the sewing needles 28 about both the side edge 35 of the work product and the chaining tongue 21, and as the work product moves along the sewing path 32, the overlock stitches slip off the distal end of the chaining tongue 21. In the meantime, as the leading thread chain 43 is being pulled from the chaining tongue 21, the overlock stitches 38 surround the leading thread chain, capturing the leading thread chain inside the overlock stitches. This forms a "latch back" configuration of the leading thread chain 43, resulting in no tail of thread chain protruding from the leading edge 36 of the work product 34 (FIG. 3).

Figure 5:
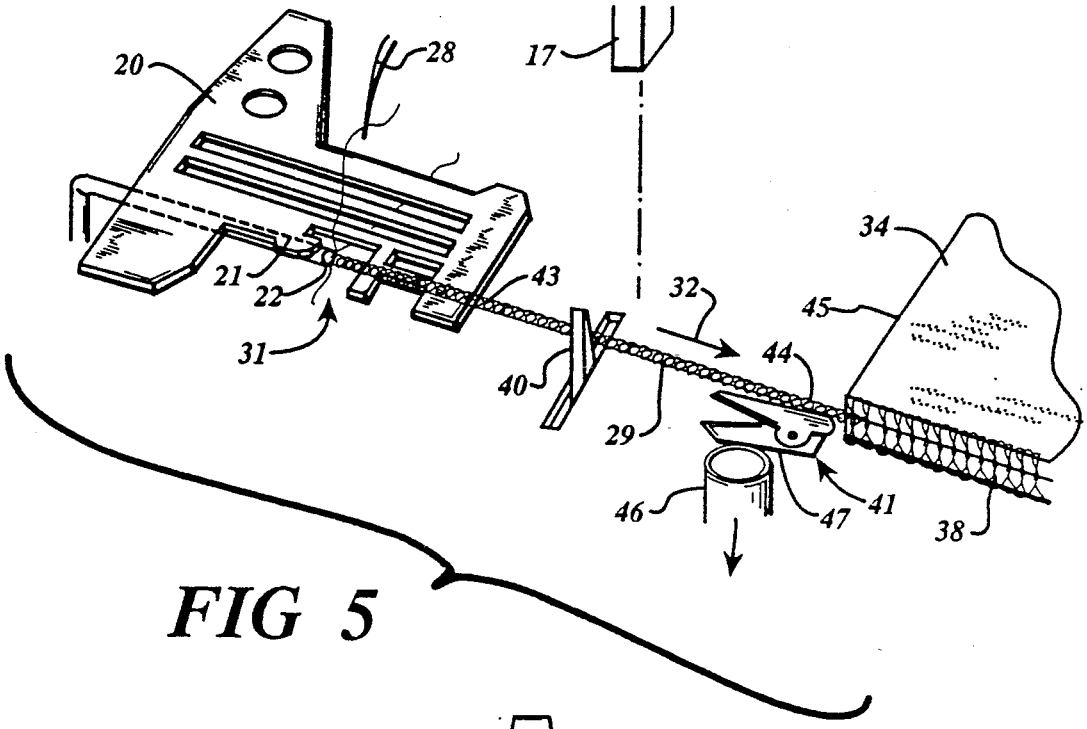
FIG. 5 is a perspective illustration of the throat plate, showing how the thread cutter and thread trimmer and photoelectric detector function to cut and trim the thread chain extending from the previously sewn work product.

As illustrated in FIG. 5, thread chain cutter 40 is positioned so as to cut across the sewing path 32, and, if desired, chain trimmer 41 can be employed to cut parallel to the sewing path 32. Thread chain cutter 40 includes a scissors type cutting mechanism of conventional design, with the cutter being placed in a position where it will straddle and therefore cut the trailing thread chain 29 which is attached to the edge 45 of the work product 34. This forms the trailing thread chain 44 and the leading thread chain 43. Thread chain trimmer 41 includes an air exhaust conduit 46 positioned adjacent a thread chain cutter 47. The air drawn into the air exhaust conduit 46 draws the trailing thread chain 44 laterally into the bite of the thread chain cutter 47, so that most of the trailing thread chain 44 is cut away from the work product 34.

As will be explained in more detail hereinafter, the conveyor system 14 (FIG. 1) operates to move the work product 34 along the sewing path 32 first at a rate equal to the rate of stitch formation at the sewing area 31, and later at a faster rate. Photoelectric detector 17 is positioned along the sewing path 32 so as to detect the trailing edge 45 of the work product 34. In response to detecting the trailing edge of the work product, air is induced to move through the open end 22 of the chaining tongue 21, the conveyor system 14 is accelerated so as to stretch the thread chain 29 extending from the trailing edge 45 of the previously sewn work product back to the chaining tongue 21 and the needles 28 (FIG. 5), the sewing machine operation is continued for a short duration, of between two and five stitches: for some work products, so that the proximal end of the leading thread chain surrounds the chaining tongue 21, and thread chain cutter 40 is operated to sever the now taut thread chain so as to form the trailing thread chain 44 and a leading thread chain 43.

The combined actions of stretching the thread chain as it is being cut, the continued forming of the thread chain about the chaining tongue and the inducement of a stream of air into the open end 22 of the chaining tongue 21 cause the leading thread chain 43 to recoil toward the chaining tongue and to be drawn into the chaining tongue, as illustrated in FIG. 2. Further, as shown in FIG. 5, the thread chain 29 extends adjacent exhaust conduit 46 so that when the thread chain is cut by the cutter 40 the trailing end 44 is drawn laterally into the air exhaust conduit 46 and is cut by the thread chain trimmer 41.

Figure 6:
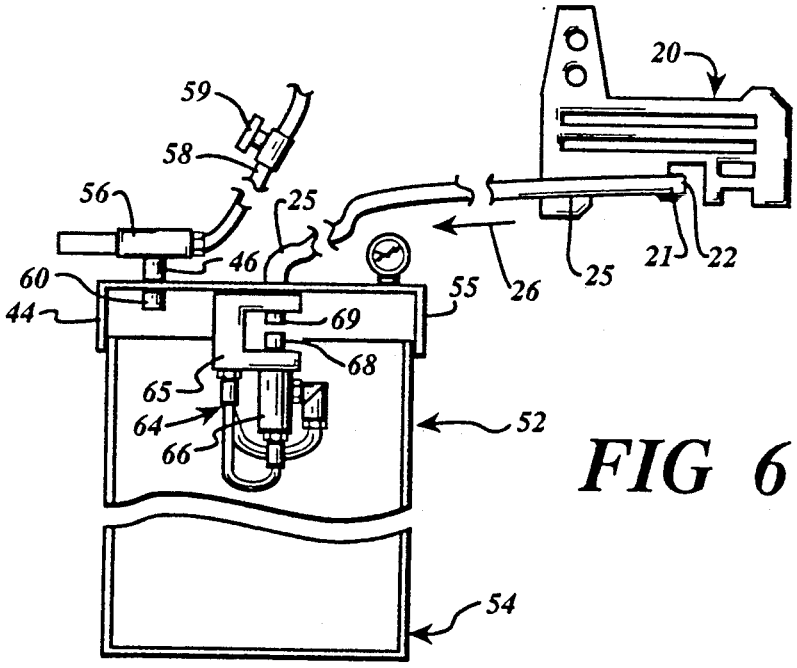
FIG. 6 is a schematic illustration of the vacuum canister and its air control valves.

As schematically shown in FIG. 6, vacuum canister 52 is arranged to induce the flow of air into the open end 22 of the chaining tongue 21 of the throat plate 20. Vacuum canister 52 includes a cylindrical housing 54 having a bottom wall and a cylindrical side wall, and a lid 55. A Venturi air flow inducer 56 is mounted to lid 55, and air pressure conduit 58 supplies a high velocity stream of air through the Venturi 56, and high velocity stream of air is controlled by control valve 59. Air inlet conduit 60 is attached to the Venturi 56 and communicates through lid 55 with the chamber defined by cylindrical housing 54.

Figure 7:
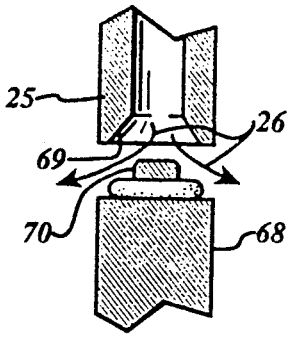
FIG. 7 is a detail illustration of the interior valve of the vacuum canister.

Internal air control valve 64 includes a C-shaped mounting bracket 65 which is suspended from lid 55 internally of the vacuum canister 52. Pneumatic cylinder 66 is supported by the bracket 65 and its cylinder rod 68 moves toward and away from valve seat 69 formed at the end of air conduit 25. Air conduit 25 extends through lid 55 and terminates at the valve seat 69 which faces the valve element 70 (FIG. 7) that is carried by the cylinder rod 68. Valve element 70 is arranged to protrude into and seal against the valve seat 69, so as to close the air conduit 25. When cylinder 66 retracts its cylinder rod 68 and the valve element 70 from the valve seat 69, the low pressure atmosphere of the canister 52 draws a rapid stream of air 26 from the atmosphere into the opening 22 of the chaining tongue 21, through air conduit 25 and into the housing 54 of the vacuum canister.

Internal air control valve 64 is controlled by the photoelectric detector 17 which detects the movement of the trailing edge 45 of the work product 34 moving away from the sewing area 31 of the sewing machine. Control valve 59 which controls the suction applied by the Venturi 56 to the vacuum canister 52 is an on-off valve and is opened to begin the evacuation of the canister 52. Typically, the valve 59 will remain open continuously during the operation of the sewing machine and its associated components so as to draw the pressure in the canister 52 down to a relatively constant desired pressure.

Typically, the internal air control valve 64 will be opened and closed for short durations, on each cycle of the sewing machine, whereas the Venturi will function continuously to continuously draw air from the vacuum canister 52. The internal volume of vacuum canister 52 is at least 400 cubic inches, therefore creating a vacuum plenum having a capacity to exert a rapid and aggressive stream of air through the chaining tongue 21 for short durations.

As illustrated in FIG. 1, the conveyor system 14 includes main conveyor 75 and tilt conveyor 76. Main conveyor 75 includes an inverted U-shaped conveyor housing 78 mounted to parallel support arms 79 and 80 which are suspended above the work table 12. Support arms 79 and 80 are mounted to a support bar 81, with the support bar being supported from work table 12 by support blocks 82. Pneumatic cylinders 84 and 85 are mounted beneath the work table 12, with the cylinder rods 86 and 87 connected to the support arms 79 and 80. The cylinders 84 and 85 rock the support arms 79 and 80 so as to lift and lower the conveyor housing 78 upwardly away from or downwardly toward engagement with the work table 12 as depicted by arrows 93.

Continuous conveyor belt 90 is mounted over belt rollers 91 and 92 at opposite ends of the conveyor housing 78, and drive motor 94 is mounted to support arm 80 and is arranged to drive belt roller 91 through a drive belt arrangement 95.

Tilt conveyor 76 is positioned adjacent sewing machine 11 and includes a support arm 98 that is pivotably mounted to conveyor housing 78 by pivot pin 99, with pivot pin 99 being coaxial with the belt roller 92 of main conveyor 75. Endless conveyor belt 100 is mounted on conveyor sheaves 96 and 97, with one conveyor sheave 97 adjacent sewing machine 11 and the other conveyor sheave 96 positioned inside conveyor housing 78 of main conveyor 75 and rotatable about an axis that is coaxial with the pivot pin 99 and the axis of rotation of belt roller 92 of main conveyor 75. Conveyor belt 100 is driven in unison with conveyor belt 90 by motor 94.

Tilt cylinder 102 is mounted on top of main conveyor housing 78, and its cylinder rod 104 is connected to support arm 98 of tilt conveyor 76. Tilt cylinder 102 functions to lift the tilt conveyor upwardly away from the work table 12 when the sewing machine operator desires to remove the tilt conveyor from the vicinity of the sewing machine. Further, tilt cylinder 102 functions to raise and lower the tilt conveyor 76 as the main conveyor 75 is lowered and raised from the work table 12, therefore assuring that the tilt conveyor 76 can always be in engagement with a work product adjacent the sewing machine regardless of the position of the main conveyor 75.

As illustrated in FIG. 1, everter system 16 is positioned adjacent an edge 105 of work table 12 and includes an everter tube assembly 106 and gripper assembly 108. Lower gripper 109 (FIGS. 9–14) is mounted below the work table 12 so that its upper surfaces are flush with the upper surfaces of the work table 12, and lower gripper 109 can be mounted in a notch 111 formed at the edge 105 of the work table, so that work products can be slid across the lower gripper 109 without obstruction. Upper gripper 110 is mounted on a telescoping support assembly 114 which includes an upright support leg 115 and an L-shaped support arm 116 having an upright section 118 that is telescopically received in upright support leg 115 and a horizontal section 119 that extends over work table 12, to support upper gripper 110.

Pneumatic cylinder 117 is arranged to raise and lower L-shaped support arm 116 and upper gripper 110, so that upper gripper 110 can be lowered toward engagement with lower gripper 109, and the two grippers can then grip adjacent plies of the work product, so as to spread or "open" the plies, as will be described in more detail hereinafter.

Figure 8:
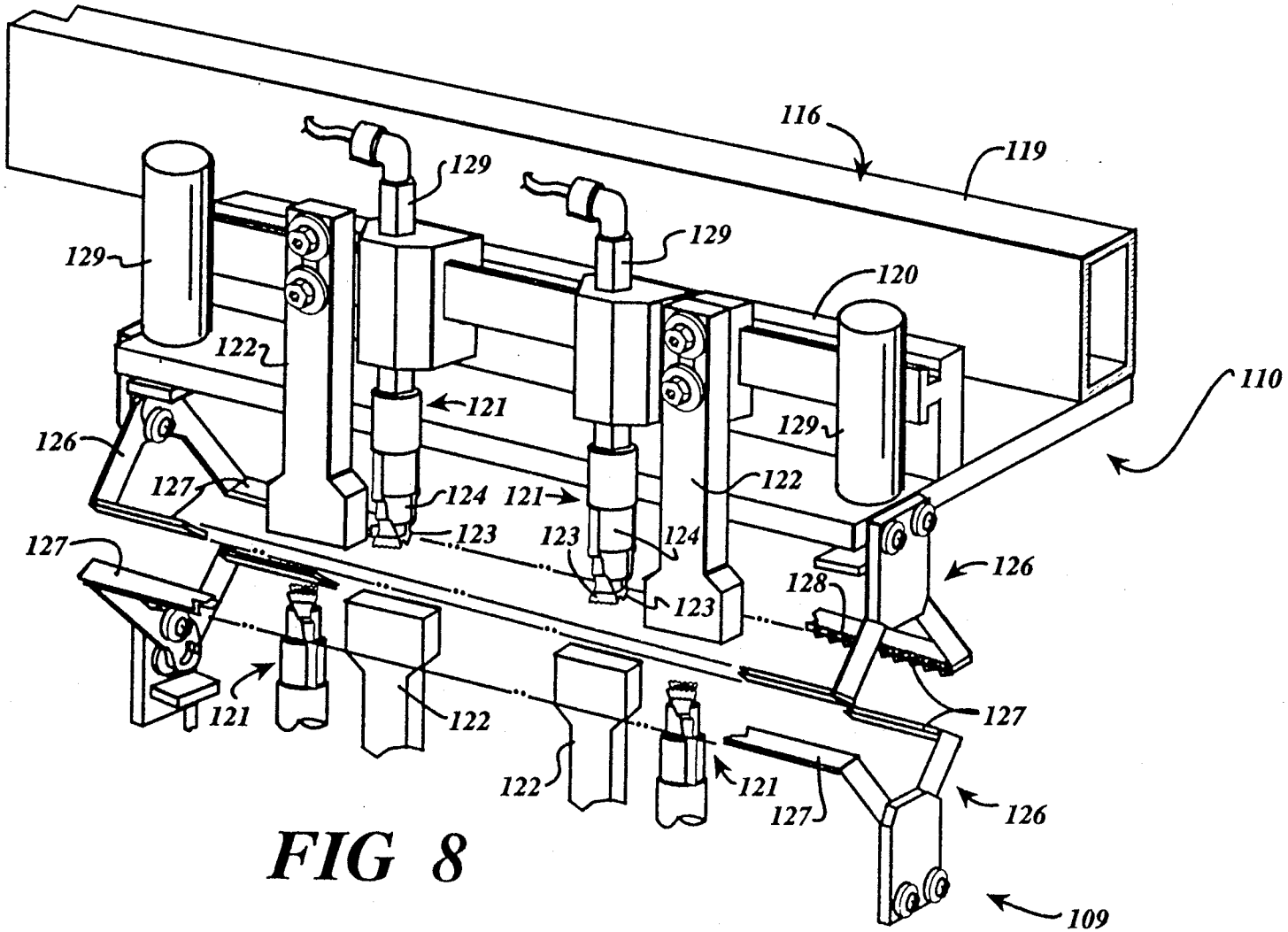
FIG. 8 is a partial perspective illustration of the upper gripper and lower gripper, showing how the anvils oppose the pickers during the picking function.
Figure 9:
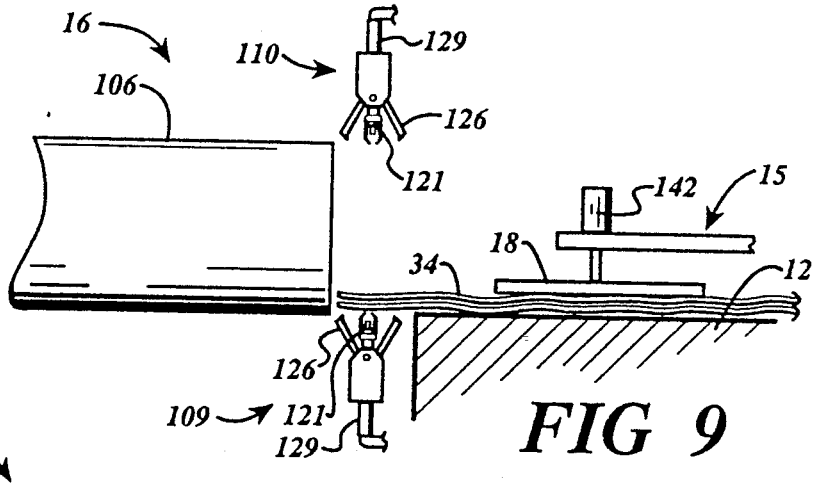
FIGS. 9–14 are progressive schematic illustrations of the grippers, showing how the grippers grip and open one end of the garment part and hold the garment part as it is everted.

As shown in FIG. 8, lower and upper grippers 109 and 110 are duplicates of each other, and each includes a support bar 120, with pickers 121 and anvils 122 mounted to the support bar and extending toward the opposite gripper. Pickers 121 are of conventional design, as disclosed by U.S. Pat. No. 4,645,193, and are available from Robotic Systems and Components of Whitinsville, Mass. In general, the pickers 121 each include a pair of opposed picking fingers 123 that are spring biased toward one another, and a plunger 124 that reciprocates under the influence of its pneumatic cylinder between and out from between the sloped end portions of the picking fingers 123 so as to alternately wedge the picking fingers apart and then to permit the picking fingers to move under the influence of their spring tension toward each other, so that the picking fingers will grasp and "pick" a ply of material away from an adjacent ply of material.

The anvils 122 of the lower gripper 109 are placed in alignment with the pickers 121 of the upper gripper, whereas the anvils 122 of the upper gripper are placed in alignment with the pickers 121 of the lower gripper. When the gripper 110 moves down toward the lower gripper 109, the anvils of the grippers provide a firm surface against which the pickers of the opposite gripper can bear, so as to grasp a ply of material positioned between the grippers.

Grippers 109 and 110 also each include jaws 126 which have a pair of clamping plates 127 movable toward and away from each about the distal ends of the pickers 121 and anvils 122, with at least one edge 128 of a pair of clamping plates including teeth 128. Pneumatic cylinders 129 are mounted in positions to operatively engage the jaws 126, causing the clamping plates to move toward and away from each other.

As illustrated in FIG. 1, transfer conveyor 15 includes a horizontally oriented transfer arm 136 which is suspended above work table 12 by being mounted at one end to upright pivotal support bar 138. Pneumatic cylinder 139 positioned below the work table 12 functions through its linkage 140 to oscillate the support bar 138 and the transfer arm 136 as indicated by double headed arrow 141, between a position where transfer arm 136 is substantially parallel to main conveyor 75 and a position coextensive with everter tube assembly 106. Clamp bar 18 is supported at the distal end of transfer arm 136 by means of pneumatic cylinder 142 and the cylinder rod 144. Guide pin 145 is rigidly mounted to the upper surface of clamp bar 18 and telescopes through an opening 146 of the transfer arm 136. With this arrangement, guide pin 145 always maintains clamp bar 118 parallel to transfer arm 136 as cylinder 142 moves the clamp bar 18 upwardly away from and downwardly toward engagement with a work product 34 on the work table 12. When a work product is moved by the main conveyor 75 to a position beneath the clamp bar, cylinder 142 moves the clamp bar downwardly into engagement with the work product 34, and cylinder 139 pivots the transfer arm 136 and clamp bar 18 to a position in alignment with everter tube assembly 106, which slides the work product 34 on the surface of the work table 12 to the position where it is aligned with the everter system 16.

Figure 15:
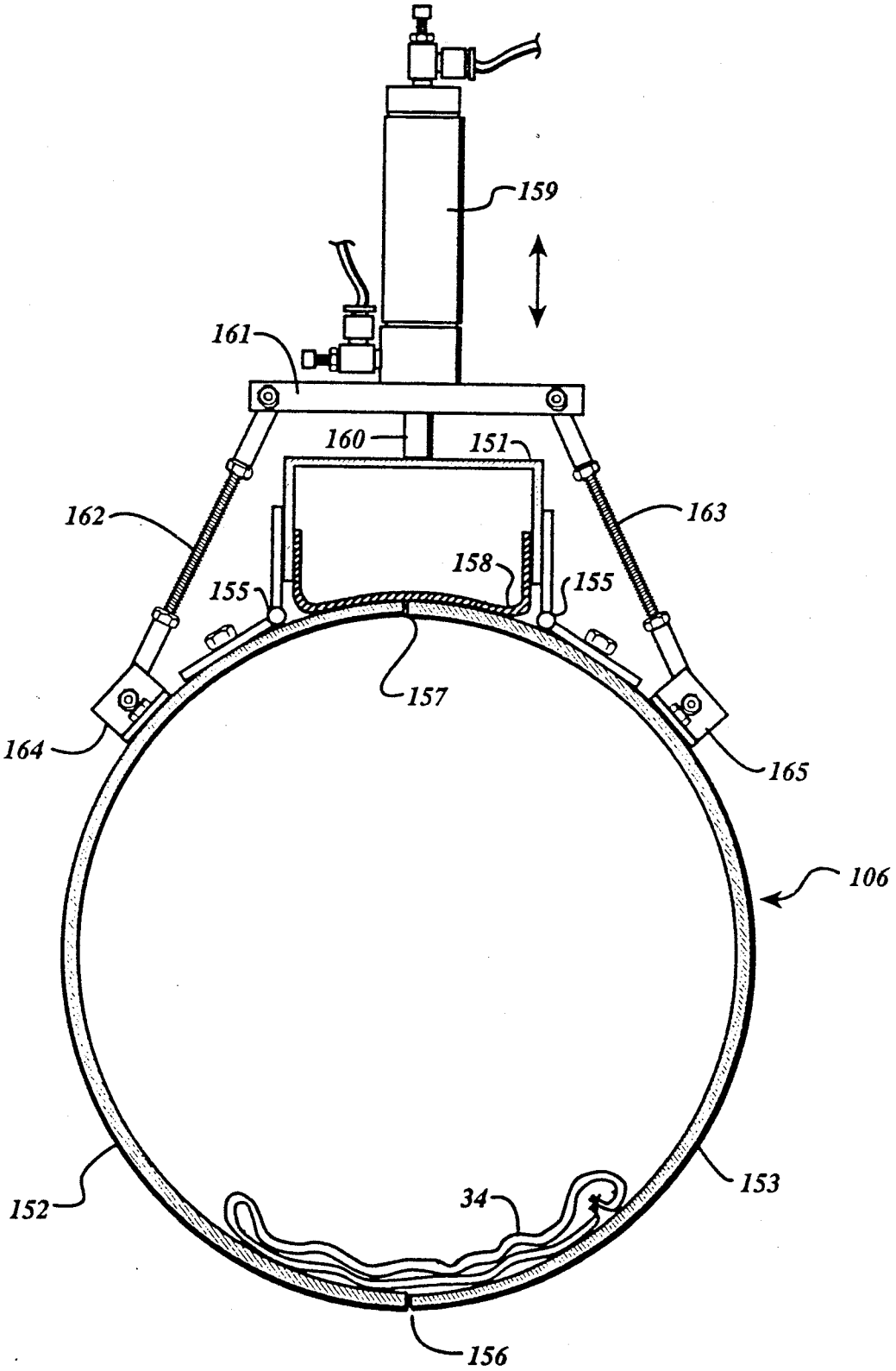
FIGS. 15 and 16 are progressive illustrations of the air induction everter tube, showing the work product after it has been everted and as it is dropped when the everter tube is opened.
Figure 16:
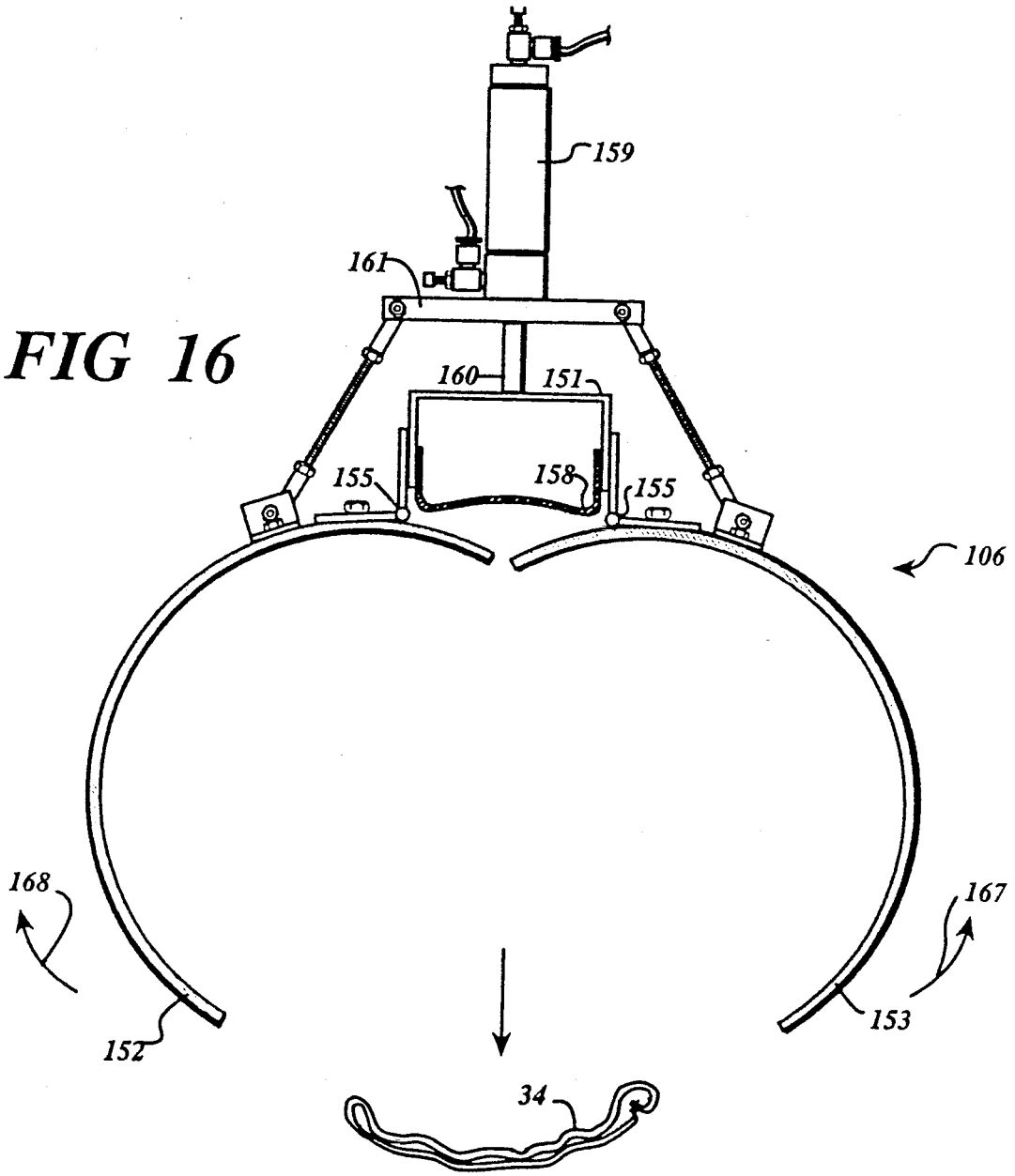

As shown in FIG. 1, everter tube assembly 106 comprises support frame 150, horizontally extending inverted U-shaped support channel 151 supported at its upper surface by support frame 150, and tube halves 152 and 153 each mounted along its upper edge by a hinge assembly 155 to opposite edges of support channel 151 (FIG. 15).

As shown in FIG. 15, tube halves 152 and 153 are semi-cylindrical and define lower and upper openable seams 156 and 157, with the hinge assemblies 155 straddling the upper openable seam 157. Flexible strip 158 is positioned in the inverted U-shaped channel 151 and is formed in a U-shape and its lower span extends over the upper openable seam 157 so as to seal the seam when a vacuum is drawn within the everter tube. Pneumatic cylinder 159 has its cylinder rod 160 mounted to the stationary support channel 151, so that when cylinder rod 160 distends, the cylinder is lifted upwardly away from support plate 151. Cross arm 161 is rigidly mounted to cylinder 159 and is movable vertically with cylinder 159, and links 162 and 163 are pivotally connected at their upper ends to the ends of cross arm 161. The lower ends of links 162 and 163 are connected by brackets 164 and 165 to the outer surfaces of the semi-cylindrical tube halves 152 and 153.

With this arrangement, when cylinder 169 has its cylinder rod 160 retracted, the cylinder halves 152 and 153 are closed together as shown in FIG. 15, forming a cylindrical conduit. When pneumatic cylinder 159 distends its cylinder rod 160 (FIG. 16), the cross arm 161 is lifted upwardly with respect to the support channel 151, so that the cylinder halves 152 and 153 move in arcs as indicated by arrows 167 and 168 about hinge assemblies 155 to form a downwardly facing opening that drops the work product 34.

Figure 17:
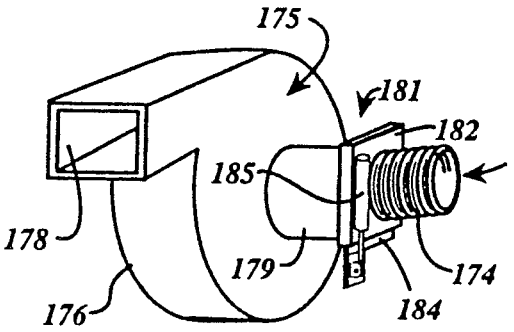
FIG. 17 is a perspective illustration of the blower which is used to induce the stream of air through the components of the system.
Figure 18:
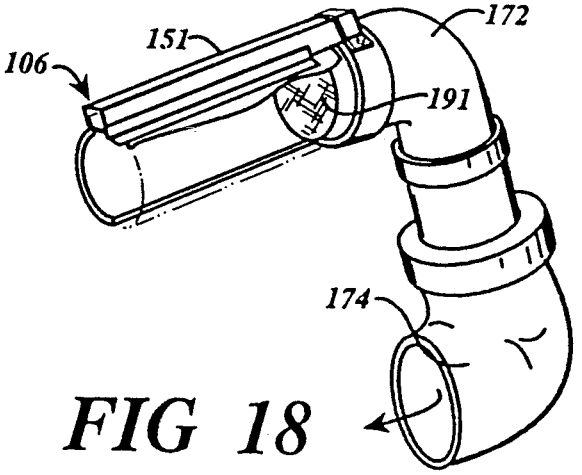
FIG. 18 is a perspective illustration, with parts broken away, of a portion of the air induction everter tube, showing its filter.
Figure 19:
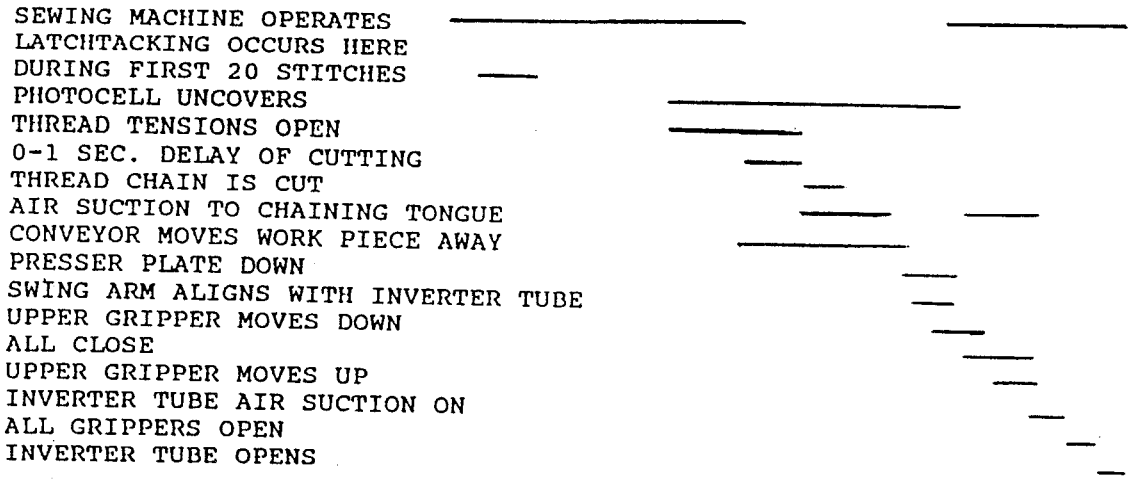
FIG. 19 is a timing diagram which shows the sequence and duration of operation of the elements of the system.

As illustrated in FIG. 1, the one end of the everter tube assembly 106 is located immediately adjacent work table 12 and the lower and upper grippers 109 and 110, whereas the other end is positioned remotely from the work table 12 and is aligned with a conduit 172 of similar size and shape as the everter tube assembly when in its closed configuration (FIG. 18). Conduit 172 is supported by support channel 151 in a stationary position, and flexible conduit 174 extends from conduit 172 to blower assembly 175 (FIG. 17).

Blower assembly 175 includes a centrifugal blower 176 having an air exhaust duct 178 which exhausts to a filter (not shown), and a centrally located air inlet (not shown). Air plenum 179 is mounted about the air inlet and includes lateral air valve 181. Air valve 181 includes a valve housing 182, valve plate 184, valve cylinder 185 and flexible conduit 174 mounted to the valve plate 184. When cylinder 185 is extended, valve plate 184 slides laterally of the valve housing 182 so that an opening is formed through the valve housing, thereby permitting the movement of air from the everter tube assembly 106, through flexible air induction conduit 174, through air valve 181, through air plenum 179 and into the inlet of blower 176. When valve plate 184 is returned by cylinder 185 it closes the valve 182 and cuts off the stream of air moving from the everter tube.

In order to avoid having work products or other solid objects passing to blower 176, a filter screen 191 (FIG. 18) is mounted to cylindrical conduit 172, in the path of the air stream moving from everter tube assembly 106 to the blower.

As illustrated in FIGS. 9–14, when a work product 34 is presented to the everter system 16 by the clamp bar 18 of the transfer conveyor 15, the work product 34 slides on the work table 12 to a position where one end of the work product is draped over the lower gripper 109. Cylinder 142 lifts the clamp bar 18 away from the work product 34 and the transfer conveyor 15 returns to its ready position adjacent conveyor system 14 (FIG. 1).

Figure 10:
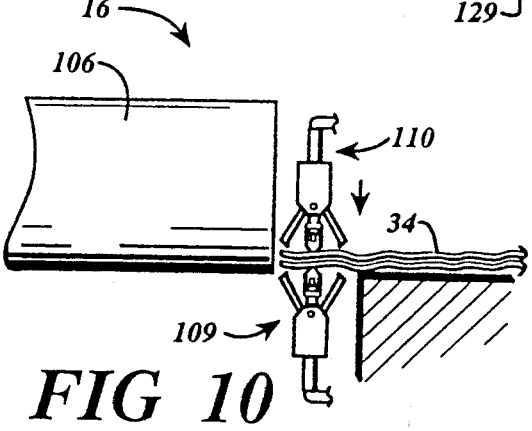

As illustrated in FIG. 10, upper gripper 110 moves down toward the work product 34 so that both the lower and upper grippers make positive contact with the work product 34. As the upper gripper becomes biased toward engagement with the lower gripper, the pickers 121 of both the lower and upper grippers open by the plungers 124 (FIG. 8) of the cylinders of the pickers protruding further between the picking fingers 123. This causes the picking fingers to move apart. This allows the picking fingers 123 be open while in contact with the lower and upper plies of the work piece 34. While the pickers are still in contact with the work piece, the plungers 124 retract, thereby allowing the spring urged picking fingers 123 to move toward each other. This movement toward each other of the picking fingers allows the teeth of the picking fingers to grasp the nap of the material, so that one ply of the material is picked away from the other ply. This picking function is assisted by the presence of the flat surfaces of the anvils 127 opposite each picking finger, to assure that a firm grip is applied by the pickers to the nap of the material.

Figure 11:
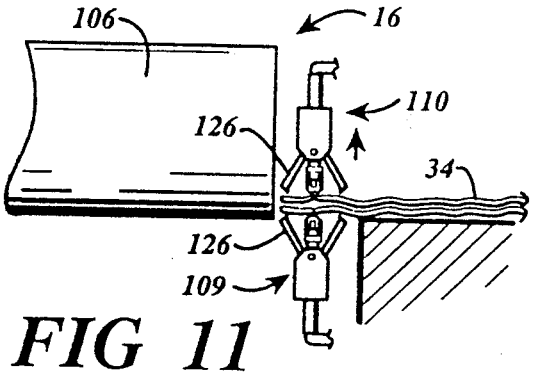
Figure 12:
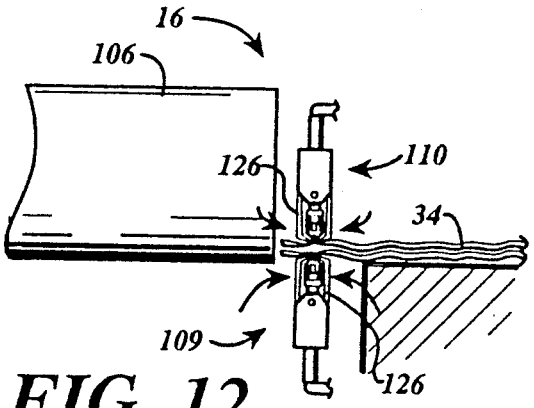
Figure 13:
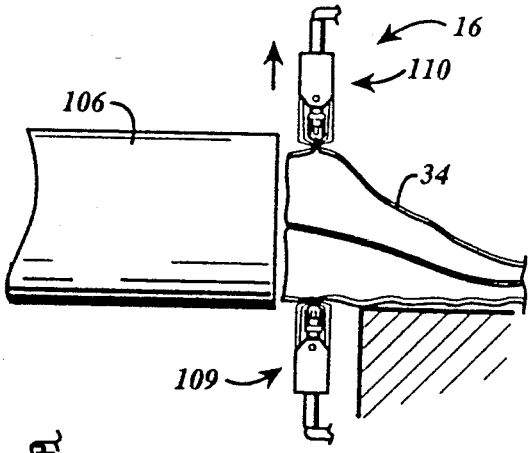

As illustrated in FIG. 11, when the upper gripper 110 begins its upward movement, the grippers will have picked the plies apart, and once the plies have been picked apart, the jaws 126 begin their closing action (FIG. 12), so as to firmly grip the plies of material. Further upward movement of the upper gripper 110 (FIGS. 13) causes the work product 34 to be opened at one end adjacent the everter tube 106. Now that the open end of the work product has been presented to the open end of the everter tube 106, valve 181 (FIG. 17) adjacent the centrifugal blower 176 is opened, thereby inducing a stream of air 190 to flow through the open end of the work product 34 and into the everter tube 106, thereby turning or "everting" the work product.

After the work product has been everted, the valve 181 at the centrifugal blower 176 (FIG. 17) is closed, thereby terminating the air stream 190 into the everter conduit 106, allowing the work product to collapse in the everter conduit 106 (FIG. 15), and the pickers and jaws of the grippers 109 and 110 are opened, thereby releasing the work product.

The now everted work product 134 is allowed to drop from the everter 106 by cylinder 159 opening the everter conduit 106 (FIG. 16), whereupon the work product 34 is dropped to an awaiting surface conveyor, container, etc.

FIG. 24 is a timing diagram which illustrates the sequence and duration of the steps of the process.

The expression "work product" has been used to describe the garment parts or other work pieces being formed by the system disclosed herein, however, it should be understood that the system can be used for forming other types of work products. Furthermore, while the terms "cylindrical" and "tubular" have been used to describe the work products, the terms are used to describe elongated work pieces, usually but not necessarily having openings at both ends.

It will be understood by those skilled in the art that the foregoing description relates only to a preferred embodiment of the present invention, and that numerous changes and modifications may be made therein without departing from the spirit and scope of the invention as set forth in the following claims.

We claim:

1. A method of forming tubular garment parts comprising:

advancing segments of garment material in a folded configuration with upper and lower plies each having an unstitched peripheral edge in series through a sewing machine;

forming stitches through a portion of the unstitched peripheral edges of the upper and lower plies of the segments of garment material to form inside out tubular garment parts having at least one open end;

moving each garment part in series away from the sewing machine and out of the way of a subsequent oncoming segment of garment material;

opening the upper and lower plies of each garment part at said at least one open end of the garment part;

creating a negative air pressure between the opened upper and lower plies of each garment part and at said at least one open end in order to evert the garment part; and releasing each everted garment part for moving to a collection of previously everted garment parts.

2. The method of forming tubular garment parts as set forth in claim 1 and wherein the step of forming stitches through the upper and lower plies of the segments of garment material comprises forming an overlock stitch along aligned edges of the garment material about a hollow chaining tongue with a thread chain extending from the rear edge of each garment part back to the needles of the sewing machine, and further including the steps of cutting the thread chain, and drawing the cut end of the thread chain at the needles of the sewing machine into the hollow chaining tongue of the sewing machine.

3. The method of forming tubular garment parts as set forth in claim 1 and wherein the step of moving the garment parts away from the sewing machine comprises aligning one end of each garment part with one end portion of a tubular conduit; and wherein the step of opening the upper and lower plies of the garment part at one end of the garment part comprises opening the end of the garment part adjacent said one end portion of the tubular conduit; and wherein the step of creating a negative air pressure between the opened upper and lower plies comprises inducing a stream of air to flow through the tubular conduit.

4. The method of forming tubular garment parts as set forth in claim 3 and wherein the step of releasing the garment part comprises opening the tubular conduit along a length thereof and dropping the garment part through the opening.

5. The method of forming tubular garment parts as set forth in claim 1 and wherein the step of moving the garment part away from the sewing machine comprises sliding the garment part across a surface of a work table from adjacent the sewing machine to a position in alignment with a first end portion of an everter tube having a first and second end portion, and wherein the step of opening the upper and lower plies of the garment part at said at least one open end of the garment part comprises aligning said at least one open end of the garment part with said first end portion of the everter tube, and wherein the step of creating a negative air pressure between the upper and lower plies comprises drawing air from the second end portion of the everter tube.

6. Apparatus for forming tubular garment parts comprising:

conveyor means for advancing a segment of garment material in a folded configuration with upper and lower plies each having an unstitched peripheral edge through the sewing machine for forming stitches through a portion of the unstitched peripheral edges of the upper and lower plies of the garment material to form a tubular garment part having at least one open end;

an everter tube assembly;

means for moving the garment part away from the sewing machine and out of the way of a subsequent oncoming segment of garment material with the open end of the garment part positioned in alignment with said everter tube assembly;

gripper means for separating the upper and lower plies of the garment part at the open end of the garment part at a position adjacent said everter tube assembly;

means for inducing a stream of air to flow between the separated upper and lower plies, through the open end of the garment part and into said everter tube assembly in a direction that everts the garment part; and means for releasing the garment part from said everter tube assembly for moving to a collection of previously everted garment parts.

7. The apparatus for forming garment parts as set forth in claim 6 and wherein said sewing machine comprises an overlock stitch sewing machine with a hollow chaining tongue for forming overlock stitches through the upper and lower plies of the garment material along aligned edges of the garment material with a thread chain extending from the rear edge of each garment part back to the needles of the sewing machine, means for stretching the thread chain, a thread chain cutter for cutting the thread chain when the thread chain is stretched, and means for drawing the cut end of the thread chain at the needles of the sewing machine into the hollow chaining tongue of the sewing machine.

8. The apparatus for forming approximately cylindrical garment parts as set forth in claim 6 and wherein said means for moving the garment part away from the sewing machine comprises aligning one end of the garment part with one end portion of a tubular conduit; and wherein said gripper means for opening the upper and lower plies of the garment part at one end of the garment part comprises an upper gripper and a lower gripper, each of said grippers including pickers for clamps to grip the plies of material after separation by said pickers, the plies of material of the garment part, and means for moving said upper and lower grippers apart for opening the garment part.

9. The apparatus for forming tubular garment parts as set forth in claim 8 and wherein said everter tube assembly comprises an elongated tube formed by semi-cylindrical tube sections, and wherein said means for releasing the garment parts comprises means for opening the tube sections away from each other and dropping the garment part through the opening.

10. The apparatus for forming tubular garment parts as set forth in claim 6 and wherein the means for moving the garment part away from the sewing machine comprises a clamp bar for moving into engagement with the garment part and sliding the garment part across the surface of a work table adjacent the sewing machine to a position in alignment with one end portion of said everter tube assembly.

11. An everter system for everting tubular garment parts comprising:

an everter tube assembly including a pair of semi-cylindrical tube sections which form an open ended tube;

means for moving said cylindrical tube sections toward and away from each other to alternately form a closed or open cylindrical tube;

air induction means aligned with one end of the cylindrical tube formed by said tube sections, and gripper means for opening and aligning one end of an approximately cylindrical work product at the other end of the cylindrical tube formed by said tube sections.

12. The everter system of claim 11 and wherein said gripper means includes upper and lower grippers, and means for moving said grippers toward and away from each other for engaging and opening the garment parts.

13. The everter of claim 12 and wherein said upper and lower grippers each include pickers for separating the plies of the cylindrical garment parts.

14. The everter of claim 13 and wherein said upper and lower grippers each comprise jaws that move toward and away from each other for gripping a garment part.

* * * * *